US006512328B2

(12) United States Patent
Makienko et al.

(10) Patent No.: US 6,512,328 B2
(45) Date of Patent: Jan. 28, 2003

(54) LASER CATHODE RAY TUBE HAVING ELECTRIC DISCHARGE INHIBITOR INSIDE THE BULB

(75) Inventors: Oleg Mikhailovich Makienko, Moskovskaya oblast (RU); Nikolai Grigoryevich Rumyantzen, deceased, late of Moscow region (RU), by Yury Vladimirivich Petrushenko, legal representative; Jong-Sik Choi, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 31 days.

(21) Appl. No.: 09/779,462

(22) Filed: Feb. 9, 2001

(65) Prior Publication Data

US 2002/0021063 A1 Feb. 21, 2002

(30) Foreign Application Priority Data

Feb. 9, 2000 (RU) ..... 00103497

(51) Int. Cl.[7] ..... H01J 31/08; H01J 31/00; H01J 31/10

(52) U.S. Cl. ..... 313/477 HC; 313/474; 313/461; 313/39; 372/43

(58) Field of Search ..... 313/477 HC, 477 R, 313/479, 474, 39, 461, 366, 318.12; 372/43, 50, 107, 74; 445/45; 348/744, 748

(56) References Cited

U.S. PATENT DOCUMENTS 3,558,956 A * 1/1971 Basov et al. ..... 313/421
5,374,870 A * 12/1994 Akhekyan et al. ... 148/DIG. 12
5,687,185 A * 11/1997 Kozlovsky et al. ..... 313/463
6,194,825 B1 * 2/2001 Kim et al. ..... 313/463
6,373,179 B1 * 4/2002 Makienko et al. ..... 313/421

FOREIGN PATENT DOCUMENTS

SU 1828321 A1 * 4/1996 ..... H01J/7/18

* cited by examiner

*Primary Examiner*—Nimeshkumar D. Patel
*Assistant Examiner*—Karabi Guharay
(74) *Attorney, Agent, or Firm*—Staas & Halsey LLP

(57) ABSTRACT

A laser CRT includes a vacuum bulb provided with a metal flange, and a laser screen secured in the metal flange and having a laser target mounted on the side of the vacuum bulb. A high-voltage input passes through the wall of the vacuum bulb at a distance from the metal flange, the laser target being electrically insulated from the metal flange and connected to the high-voltage input through an electrically conductive element disposed inside the vacuum bulb. The laser CRT further includes two screening electrodes mounted inside the vacuum bulb in the interspace between the wall of the vacuum bulb, the metal flange, the high-voltage input and the electrically conductive element, the screening electrodes being respectively connected to the high-voltage input and to the metal flange and extending from them towards each other so as to prevent electrical discharges between the metal flange and the high-voltage input and between the metal flange and the electrically conductive element in the interspace.

16 Claims, 2 Drawing Sheets

LASER CATHODE RAY TUBE HAVING ELECTRIC DISCHARGE INHIBITOR INSIDE THE BULB

CROSS-REFERENCE TO RELATED APPLICATIONS

This application claims the benefit of Russian Application No. RU20010349, filed Feb. 9, 2000, in the Russian Patent Office, the disclosure of which is incorporated herein by reference.

BACKGROUND OF THE INVENTION

1. Field of the Invention

The invention relates to electronic and quantum devices, and more particularly, to laser cathode-ray tubes, e.g., used in projection television systems for displaying images on large screens.

2. Description of the Related Art

Projection television equipment based on conventional cathode ray tubes (CRT) having a luminescent screen is widely used for displaying images on projection screens having an area of up to several square meters. However, the size of an image on the projection screens of such equipment is limited as luminescent screens cannot form light flux of high intensity, thus making it difficult to form television images having the required brightness and contrast.

An effective way to improve the parameters of a projection television systems is to connect with laser CRTs (see, for example, U.S. Pat. No. 3,558,956).

As distinct from conventional CRTs, the source of radiation in the laser CRT is a laser target, not a luminescent layer, the laser target representing a thin semiconductor monocrystalline plate having both its parallel surfaces covered by light reflecting coatings.

A fully reflecting mirror metal coating is usually applied to the surface on which the electron beam is incident, while the opposed side of the plate is covered with a semitransparent mirror coating. The mirror surfaces constitute an optical resonator, while the semiconductor plate between them acts as an active medium of the laser with electron-beam excitation (pumping).

The laser target is fixed to a substrate of a transparent dielectric material, the substrate serving as the optical output window of the laser CRT and also as a heat sink for the laser target. The substrate is usually made of sapphire having a high thermal conductivity. The laser target, together with the transparent substrate, constitutes the screen of the laser CRT (laser screen).

The electron beam penetrates into the semiconductor plate through the metal coating and induces spontaneous light radiation. When the surface density of the current produced by the beam on the laser target exceeds a threshold value, the power of the induced light radiation will be greater than the losses in the optical resonator and the element of the laser target on which the electron beam is incident will generate laser radiation.

When the light passes repeatedly through the resonator, its spectrum narrows, with the result being that the emitted light is substantially monochromatic. The laser light is radiated through the semitransparent mirror coating in essence perpendicularly to the surface of the semiconductor plate and leaves the CRT through the sapphire output window.

Because the threshold value of the beam density decreases with a decrease in the temperature of the laser target, the laser screens are usually cooled to cryogenic temperatures in order to increase the intensity of the light radiation produced by the CRT and decrease its power requirements.

Known is a laser CRT (V. N. Ulasjuk. Kvantoskopy. "Radio i svjaz", Moscow, 1988,p. 105,207) comprising a vacuum bulb provided with a metal flange, a laser screen secured in the metal flange and having a laser target mounted on the side of the vacuum bulb.

For required acceleration of the electron beam, the laser target shall be under a high positive potential (about 30–70 kV) with respect to the cathode. In the known laser CRT, the cathode is connected to a source of a high negative potential, while the laser target is grounded. With the accelerating voltage supplied in this manner, the laser screen can be easily connected to the grounded system for cooling the laser target.

However, application of the high potential to the cathode extremely complicates the electrical circuits connected to the cathode and to the electrodes adjacent to the cathode. Such circuits include, for example, cathode filament supply circuits, video signal amplifiers, bias voltage sources, etc.

The complexity of these electrical circuits is caused by the necessity to take measure for electrically isolating these circuits from ground and results in an increase in the manufacturing expenses and thus in the cost of apparatuses based on such laser CRT'S.

On the other hand, if the cathode is grounded and a high positive potential is applied to the laser target, the laser target shall be isolated from the flange which is used to attach the CRT to the grounded cooling system.

As a result, the electrical field of high intensity occurs between, on the one hand, the laser target with the elements providing application of the high potential to the laser target and, on the other hand, the metal flange.

The large electric field strength is caused by relatively small distances between the grounded flange and the elements which are at the high positive potential, including the laser target. The large electric field strength may, in turn, result in the appearance of electrical discharges, such as breakdowns or micro discharges, in the high-voltage interspace between the flange and the above-mentioned elements which are at the high potential.

The breakdown of the high-voltage interspace can result in complete destruction of the CRT, while frequent micro discharges reduce the service life of the laser CRT and impair the quality of the image formed by it.

SUMMARY OF THE INVENTION

It is an object of the present invention to provide a laser CRT capable of grounding the electrical circuits connected to the cathode of the CRT, while preventing at the same time the occurrence of electrical discharges between the metal flange of the vacuum bulb and the laser target and elements connected thereto, to decrease thereby the manufacturing expenses and cost of the equipment without substantially reducing the CRT service life.

Additional objects and advantages of the invention will be set forth in part in the description which follows and, in part, will be obvious from the description, or may be learned by practice of the invention.

With the above and other objects in view, there is proposed a laser CRT comprising a vacuum bulb provided with a metal flange, a laser screen secured in the metal flange and having a laser target mounted on the side of the vacuum bulb, the laser target being electrically insulated from the metal flange, a high-voltage input passing through the wall of the vacuum bulb at a distance from the metal flange, an electrically conductive element disposed inside the vacuum bulb and connecting the laser target to the high-voltage input, and two screening electrodes mounted inside the vacuum bulb in the interspace between the wall of the vacuum bulb, the metal flange, the high-voltage input and the electrically conductive element, wherein the screening electrodes are respectively connected to the high-voltage input and to the metal flange and extend from them towards each other so as to prevent electrical discharges between the metal flange and high voltage input and between the metal flange and electrically conductive element in the interspace.

The application of high potential through the high-voltage input and electrically conductive element to the laser target electrically insulated from the metal flange of the CRT provides the possibility of grounding both the cooling system connected to the metal flange of the CRT, and the electrical circuits connected to the cathode of the CRT, thus allowing significant simplification of the equipment using the laser CRT.

However, in such a laser CRT, the distance between its grounded parts and its parts which are at a high potential (i.e., between, on the one hand, the metal flange of the CRT and, on the other hand, the high-voltage input, the electrically conductive element and the laser target) becomes much less than in the known laser CRT.

With the potential of the laser target having been set, a decrease in the distance leads to an increase in the electric field strength, which, in turn, causes electrical discharges in the form of breakdowns or micro discharges to appear in the high-voltage interspace between the wall of the vacuum bulb, the metal flange, the high-voltage input and the electrically conductive element.

Such discharges are most likely to appear if the high-voltage interspace includes local areas of elevated electric field strength. Such areas occur near elements that are pointed or have a small diameter, in particular, near the high-voltage input, which has a relatively small diameter, in the region of an angular connection of the electrically conducting element with the laser target, and on sharp edges of the CRT metal flange.

The introduction, according to the invention, of the screening electrodes makes it possible to screen the above-mentioned areas and to form a uniformly distributed electrical field having no local sites of excessively increased intensity in the high-voltage interspace.

The breakdown strength of the high-voltage interspace is thus increased, thereby permitting the laser target potential to be increased up to a required value without the occurrence of breakdowns and micro discharges, or at least with their frequency being low enough so as to minimize a deterioration in the service life and quality of a formed image of the laser CRT.

The screening electrodes preferably have edges facing each other and having a rounded form, e.g., they may be bent back. The rounded form of the electrodes provides a smaller electric field strength around their edges. The radius of the roundness of the screening electrodes preferably exceeds approximately 1 mm. The screening electrodes may be bent toward the wall of the vacuum bulb. Preferably, the screening electrodes have polished surfaces.

The screening electrode connected with the metal flange preferably has its edge nearest the high-voltage input spaced from the high-voltage input by a distance smaller than that by which the metal flange edge nearest the high-voltage input is spaced from the high-voltage input. This allows the sharp edge of the metal flange soldered in the glass vacuum bulb of the CRT to be screened from the CRT elements which are at the high potential, and thus prevents a high electric field strength area from appearing around this edge of the metal flange.

The above-mentioned electrically conductive element preferably includes a ring embracing a space behind the laser target, while the screening electrodes include rings embracing the ring constituting the electrically conductive element. With the electrically conductive element and the screening electrodes so configured, the most uniform distribution of the electric field intensity all over the high voltage interspace is achieved.

A ring made of dielectric material may be attached to the laser screen on the side of the laser target, the dielectric ring being mounted in the space between the rings of the screening electrodes and the ring constituting the electrically conductive element. The presence of the dielectric ring makes it possible to further increase the breakdown strength of the high voltage interspace.

The above-mentioned electrically conductive element may include a coating made of a conductive material and deposited on the inner surface of the dielectric ring. Such a combined design of the dielectric ring and the electrically conductive element makes the manufacture of the CRT substantially less labor-consuming. The high-voltage input may be connected with the above-mentioned conductive coating using a contact spring.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE PREFERRED EMBODIMENTS

Figure 1:
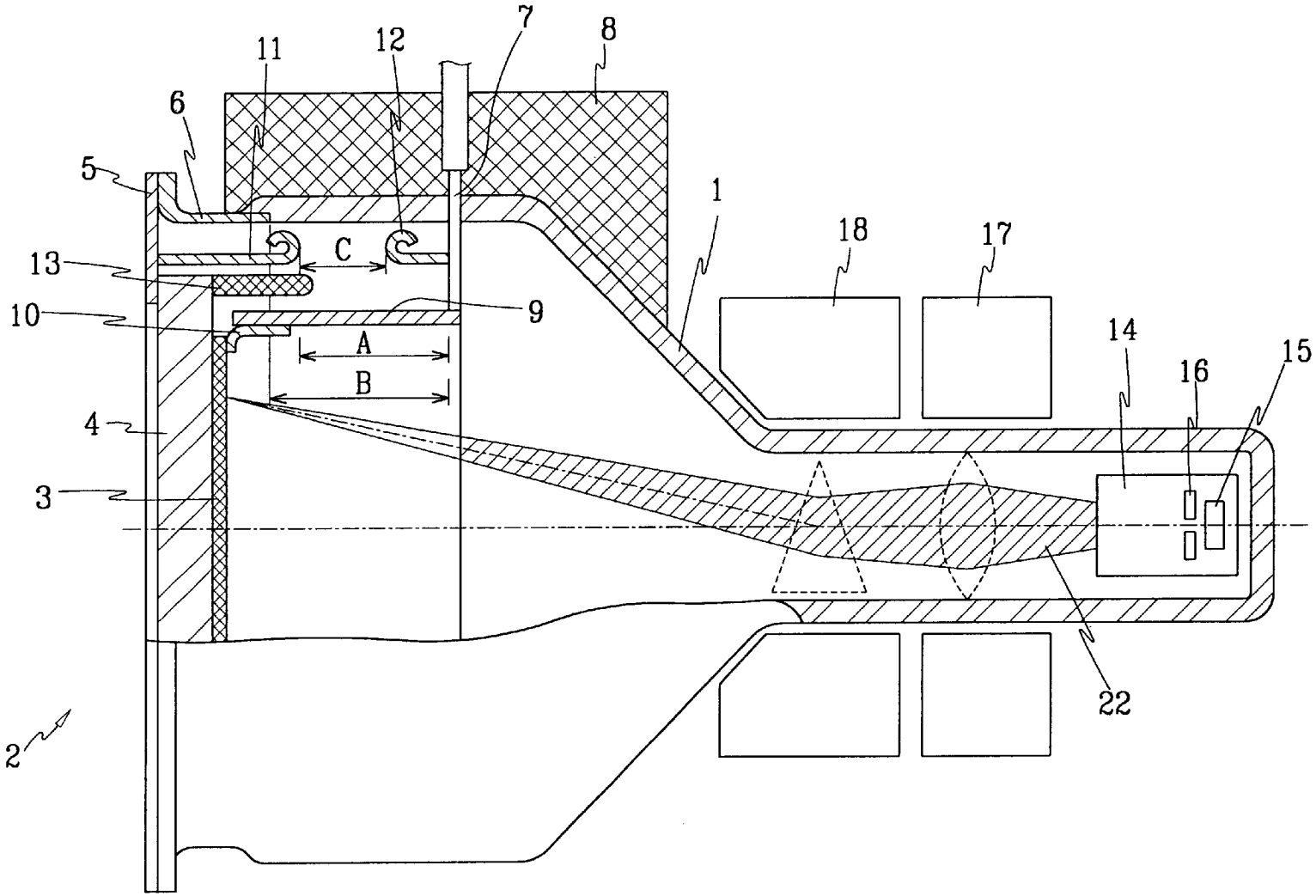
FIG. 1 schematically shows a longitudinal section view depicting a laser CRT according to a first embodiment of the invention.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

The laser CRT shown in FIG. 1 comprises a vacuum bulb 1 and a laser screen 2 installed on the end of the vacuum bulb 1. The laser screen 2 includes a laser target 3, the laser target 3 being bonded to the end surface of a transparent substrate 4 on the side of the vacuum bulb 1. The transparent substrate 4 can be made of sapphire.

The laser screen 2 is fixed in a metal flange 5 by hermetical connection of this metal flange 5 to the transparent substrate end surface opposite to the laser target 3. The transparent substrate 4 electrically insulates the laser target 3 from the metal flange 5. The connection of the transparent substrate 4 with the metal flange 5 can be made by soldering. The metal flange 5 is, in turn, hermetically connected to a second metal flange 6 soldered to the vacuum bulb 1 of the CRT. The metal flanges 5 and 6 can be made of Kovar, which is an Ni alloy containing cobalt and iron, and connected to one another, e.g., by soldering or welding.

A high-voltage input 7 is located on the side surface of the vacuum bulb 1 at some distance from the metal flange 6. The high-voltage input 7 is arranged for applying a positive potential relative to ground to the laser target 3. The high-voltage input 7 comprises a metal pin hermetically soldered in the wall of the vacuum bulb 1. The distance from the high-voltage input 7 to the metal flange 6 is selected so as to prevent the occurrence of electrical breakdown between these elements. On the outside of the vacuum bulb 1, the high-voltage input 7 is potted in a compound 8.

The laser target 3 is connected to the high-voltage input 7 through an electrically conductive element located inside the vacuum bulb 1. In the embodiment shown in FIG. 1 the electrically conductive element comprises a ring 9 made of a non-magnetic conductive material and embracing the space behind the laser target 3. One edge of the ring 9 is connected, e.g., by soldering or welding, to the end of the high-voltage input 7 located inside the vacuum bulb 1. Around the circumference of the other edge of the ring 9 a contact spring 10 is arranged to ensure reliable electrical contact with the metal coating on the surface of the laser target 3. The configuration of the ring 9 is selected such that this ring does not hinder the passage of the electron beam directed to the laser target 3.

Inside the vacuum bulb 1 two screening electrodes 11 and 12 are installed in the interspace between the walls of the vacuum bulb 1, metal flanges 5 and 6, the high-voltage input 7 and the ring 9. The screening electrodes 11 and 12 are respectively connected to the high-voltage input 7 and the metal flange 5 and extend from them towards each other. The shape and arrangement of the screening electrodes 11 and 12 are selected so as to prevent the electrical discharges to appear between the metal flanges 5, 6 and the high-voltage input 7 and between the metal flanges 5, 6 and the ring 9 in the high-voltage interspace between the walls of the bulb 1, the flanges 5 and 6, the high-voltage input 7 and the ring 9.

In the first embodiment shown in FIG. 1, the screening electrodes 11 and 12 have the form of rings embracing the ring 9 constituting the electrically conductive element. Edges of the screening electrodes 11 and 12 facing each other have a rounded form and are bent toward the wall of the vacuum bulb 1. The radius of the roundness of the screening electrodes preferably exceeds approximately 1 mm. The surfaces of the screening electrodes 11 and 12, especially their surfaces facing each other, can be polished.

The screening electrode 11 connected with the metal flange 5 has such a length that the edge nearest the high-voltage input 7 is spaced from the high-voltage input 7 by a distance A smaller than a distance B by which the sharp edge of the metal flange 6 nearest the high-voltage input 7 is spaced from the high-voltage input 7. At the same time, the distance C between the screening electrode edges nearest each other is great enough to prevent the electrical breakdown between them.

A ring 13 made of a dielectric material is installed in the interspace between the rings of the screening electrodes 11 and 12 and the ring 9 constituting the electrically conductive element. The dielectric ring 13 is attached, e.g. by adhesive, to the laser screen 2 at a side of the laser target 3.

The dielectric ring 13 is aligned to be parallel with the centerline (the dotted line in FIGS. 1 and 2) of the CRT. One end portion of the ring 9 nearest the metal flanges 5 and 6 thus overlaps the dielectric ring 13.

Opposite to the laser screen 2, in the neck of the glass vacuum bulb 1 of the CRT, an electron gun 14 is installed, the electron gun 14 including a cathode 15 connected substantially to ground and a modulator 16. The cathode 15 and the modulator 16 have a conventional design used in known laser CRTs.

On the outer surface of the neck of the vacuum bulb 1, an electromagnetic focusing system 17 and an electromagnetic deflection system 18 are mounted. The focusing system 17 is arranged for focusing the electron beam on the laser target 3. The deflection system 18 includes coils (not shown) for vertical and horizontal deflection of the focused electron beam.

Figure 2:
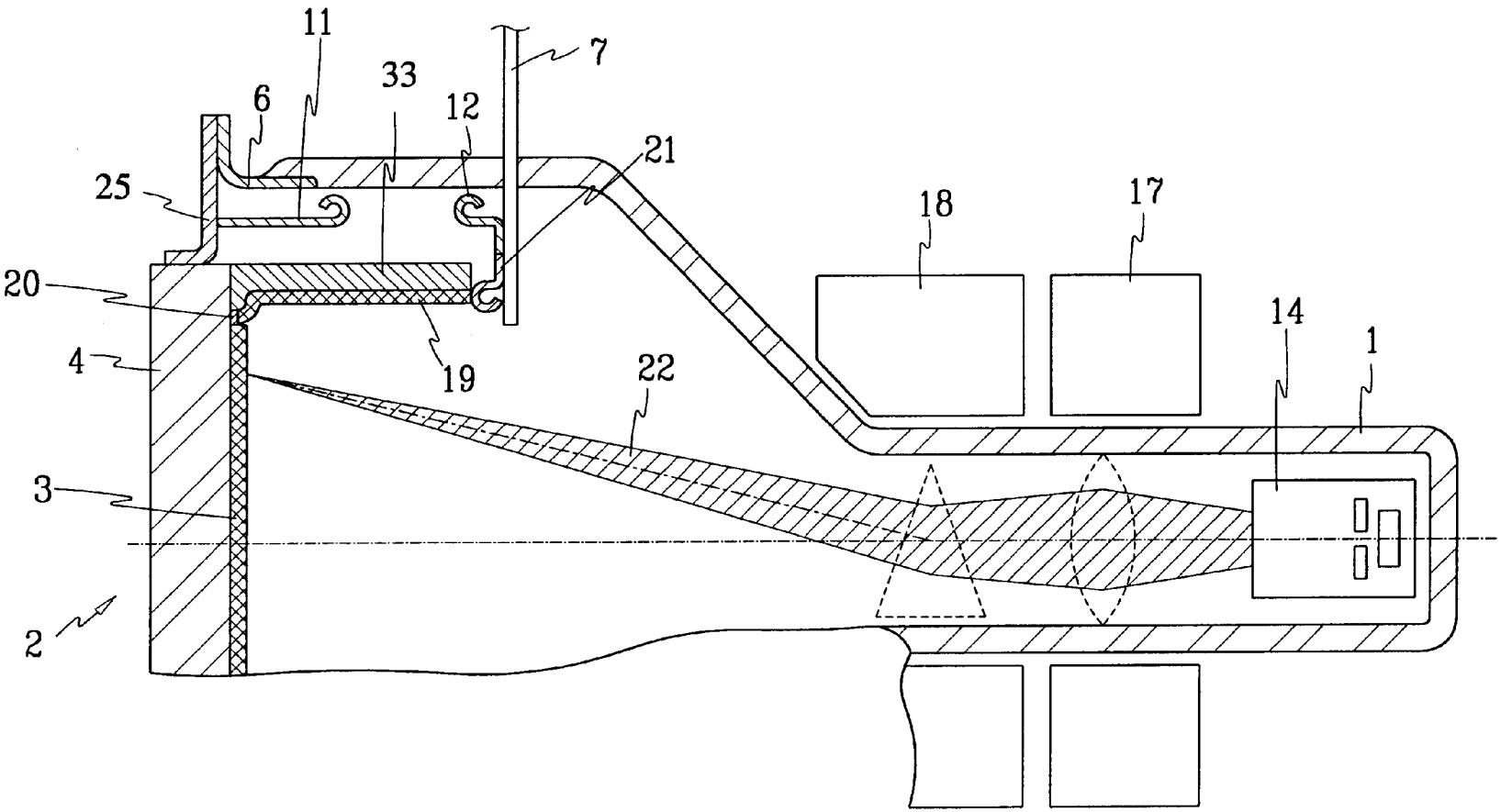
FIG. 2 schematically shows a longitudinal section view a laser CRT according to a second embodiment of the invention.

FIG. 2 shows a second embodiment of the laser CRT according to the invention. As can be seen from FIG. 2, in this embodiment, a metal flange 25 (similar to the metal flange 5 in FIG. 1) is connected with an edge surface of the transparent substrate 4, not with its side surface. However, in this case, the transparent substrate 4 also electrically insulates the laser target 3 from the metal flange 25.

In this embodiment, the ring constituting the electrically conductive element is constituted by a coating 19 made of a conductive material and deposited on the inner surface of a dielectric ring 33 (similar to the dielectric ring 13 in FIG. 1). The coating 19 can be deposited by evaporation or chemically. The coating 19 is connected to the laser target 3 by a contact conductive coating 20. The high-voltage input 7 is connected to the conductive coating 19 by a contact spring 21. In FIG. 2, the contact spring 21 is pressed to the end surface of the dielectric ring 33 which is covered by a conductive coating connected with the coating 19 deposited on the inner surface thereof. The remaining elements shown in FIG. 2 are similar to the elements shown in FIG. 1 and designated by the same numerals.

The laser CRT operates as follows.

The electron gun 14 generates an electron beam 22, the current of the electron beam 22 depending on the voltage of the video signal applied to the modulator 16 of the electron gun 14. Because the cathode 15 of the CRT is at ground potential, standard video amplifiers having grounded common wires and similar to those used in television devices with conventional projection luminescent CRT's can be connected to the modulator 16 without taking special measures for their electrical isolation. Other circuits usually connected to the electron gun 14 (filament voltage source, etc.) also may be conventional circuits having grounded common wires and employed usually with CRT's.

A flange of a cooling system (not shown) is connected from the outside to the metal flange 5 (or 25). The cooling system may be of conventional type and, e.g., include a channel for passing a cooling medium. The cooling system cools the laser target 3 to a predetermined temperature. This provides reduction in the threshold current density on the laser target 3 and increase in the intensity of the CRT light radiation. Because the grounded cooling system is connected to the metal flange 5, which is also at ground potential and isolated from the high positive voltage, the cooling system may have a standard design. Using sapphire as the material for making the transparent substrate 4 allows the laser target 3 to be effectively cooled due to the high thermal conductivity of sapphire under low temperature.

A high positive voltage relative to ground is applied to the laser target 3 through the high-voltage input 7. The electron beam 22 under the action of the high accelerating voltage applied through the high-voltage input 7 and the ring 9, or the coating 19, to the laser target 3, is directed to the laser target 3. The current passed through the electromagnetic coil of the focusing system 17 provides point magnetic focusing of the electron beam 22 on the laser target 3. During magnetic focusing, the magnetic field produced by the focusing system 17 forms a magnetic lens (shown by a dashed line) which collects the divergent electron beam 22 generated by the electron gun 14 into a narrow converging beam.

The coils of the deflection system 18 are supplied with horizontal and vertical scanning signals of a sawtooth form. The magnetic fields of the electromagnetic coils deflect the electron beam 22 in horizontal and vertical directions, forming a television raster, in the same way as it is formed in known CRTs. The synchronized supply of the laser CRT with scanning and video signals provides formation of a television image projected from the laser CRT to an external projection screen (not shown).

The screening electrodes 11 and 12 located in the high-voltage interspace screen the high-voltage input 7 having a relatively small diameter and the electrically conducting ring 9 from the sharp edge of the grounded metal flange 6 soldered to the glass of the vacuum bulb 1. This screening prevents an excessive increase of the electric field intensity around the high-voltage input 7 and the edge of the metal flange 6.

The implementation of the screening electrodes 11 and 12 in the form of rings embracing the ring 9 provides the most uniform distribution of electric field intensity all over the high-voltage interspace. The rounded form of the ends of the screening electrodes 11 and 12 with a radius not less than 1 mm makes it possible to lower the electric field intensity around the ends of the screening electrodes 11 and 12.

The ring 13, made of a dielectric material, prevents the occurrence of electrical breakdown between the edge of the laser target 3, which is connected at a right angle to the conductive ring 9, and the grounded metal flanges 5 and 6, i.e. in the area where the length of the high-voltage interspace is smallest.

Thus, in the laser CRT according to the embodiments of the present invention, the occurrence of destructive electrical breakdowns is prevented and the probability of the appearance of micro discharges is sharply reduced, while the potential of the laser target 3 is sufficient for normal performance of the CRT. Due to the increased breakdown strength of the high-voltage interspace, the proposed laser CRT provides the possibility of supplying a high positive potential to the laser target 3, while the cooling system is grounded. The cathode is also at a ground potential, which, as was indicated above, provides simplification of the electrical circuits connected to the CRT and thus reduction in the equipment cost.

The described design of the laser CRT with the magnetic focusing and deflection of the electron beam is presented only as an example. In various embodiments of the invention any known ways of generation, focusing and deflection of electron beams, such as used in CRTs and other similar devices, as well as different types of laser targets, can be used.

What is claimed is:

1. A laser cathode ray tube, comprising:

a vacuum bulb provided with a metal flange;

a laser screen secured to the metal flange and having a laser target mounted at a side of the vacuum bulb, the laser target being electrically insulated from the metal flange;

a high-voltage input passing through a wall of the vacuum bulb at a distance from the metal flange;

an electrically conductive element disposed inside the vacuum bulb and connecting the laser target to the high-voltage input; and first and second screening electrodes mounted inside the vacuum bulb in an interspace between the wall of the vacuum bulb, the metal flange, the high-voltage input and the electrically conductive element, wherein the first and second screening electrodes are respectively connected to and extend from the high-voltage input and the metal flange towards each other so as to prevent electrical discharges between the metal flange and the high voltage input and between the metal flange and the electrically conductive element in the interspace.

2. The laser cathode ray tube of claim 1, wherein edges of the first and second screening electrodes facing each other have a rounded form.

3. The laser cathode ray tube of claim 2, wherein the edges of the first and second screening electrodes facing each other are bent back.

4. The laser cathode ray tube of claim 3, wherein the first and second screening electrodes are bent toward the wall of the vacuum bulb.

5. The laser cathode ray tube of claim 2, wherein a radius of roundness exceeds approximately 1 mm.

6. The laser cathode ray tube of claim 2, wherein the second screening electrode connected to the metal flange has the edge nearest the high-voltage input spaced from the high-voltage input by a distance smaller than that by which an edge of the metal flange nearest the high-voltage input is spaced from the high-voltage input.

7. The laser cathode ray tube of claim 1, wherein the first and second screening electrodes have polished surfaces.

8. The laser cathode ray tube of claim 1, wherein the electrically conductive element comprises a first ring positioned in a space behind the laser target, while the first and second screening electrodes comprise second rings embracing the first ring.

9. The laser cathode ray tube of claim 8, wherein the laser screen further comprises a third ring, made of a dielectric material, which is attached to the laser screen on the side of the laser target, the third ring being mounted in a space between the second rings of the first and second screening electrodes and the first ring.

10. The laser cathode ray tube of claim 9, wherein the first ring consists of a coating made of a conductive material and deposited on an inner surface of the third ring.

11. The laser cathode ray tube of claim 10 further comprising a contact spring connecting the high-voltage input to the coating made of the conductive material.

12. A laser cathode ray tube, comprising:

a vacuum tube provided with a metal flange;

a laser screen secured to the metal flange and having a laser target mounted at a side of the vacuum bulb;

a high-voltage input passing through a wall of the vacuum bulb at a distance from the metal flange;

a cathode being substantially grounded; and an electrical discharge inhibitor which prevents electrical discharges between the metal flange and the high-voltage input.

13. The laser cathode ray tube of claim 12, wherein the electrical discharge inhibitor comprises first and second screening electrodes.

14. The laser cathode ray tube of claim 13, further comprising:

an electrically conductive element connecting the laser target to the high-voltage input;

wherein the first and second screening electrodes are mounted in an interspace between the wall of the vacuum bulb, the metal flange, the high-voltage input and the electrically conductive element.

15. The laser cathode ray tube of claim 14, wherein the first and second screening electrodes are respectively connected to the high-voltage input and the metal flange and extend toward each other.

16. The laser cathode ray tube of claim 14, wherein the second screening electrode connected to the metal flange has an edge nearest the high-voltage input spaced from the high-voltage input by a first distance smaller than a second distance at which an edge of the metal flange nearest the high-voltage input is spaced from the high-voltage input.

* * * * *

UNITED STATES PATENT AND TRADEMARK OFFICE

CERTIFICATE OF CORRECTION

PATENT NO. : 6,512,328 B2 
DATED : January 28, 2003
INVENTOR(S) : Oleg Mikhailovich Makienko et al.

It is certified that error appears in the above-identified patent and that said Letters Patent is hereby corrected as shown below:

Title page,
Item [56], OTHER PUBLICATIONS, insert -- V.N. Ulasjuk Kvantoskopy. "Radio I svjaz", Moscow, 1988, pp. 105 and 207 --.
Item [30], Foreign Application Priority Data, change "00103497" to -- 200103497 --.

Signed and Sealed this

First Day of July, 2003

JAMES E. ROGAN
*Director of the United States Patent and Trademark Office*